US010081942B2

(12) United States Patent
Berg

(10) Patent No.: US 10,081,942 B2
(45) Date of Patent: Sep. 25, 2018

(54) BUILDING ELEMENT, A BUILDING COMPRISING ONE OR MORE SUCH BUILDING ELEMENTS AND A METHOD FOR JOINING SUCH A BUILDING ELEMENT AND A SUPPORT ELEMENT

(71) Applicant: Svein Berg Holding AS, Åndalsnes (NO)

(72) Inventor: Svein Berg, Isfjorden (NO)

(73) Assignee: Svein Berg Holding AS, Andalsnes (NO)

( * ) Notice: Subject to any disclaimer, the term of this patent is extended or adjusted under 35 U.S.C. 154(b) by 0 days.

(21) Appl. No.: 15/329,711

(22) PCT Filed: Aug. 3, 2015

(86) PCT No.: PCT/IB2015/001530

§ 371 (c)(1),
(2) Date: Jan. 27, 2017

(87) PCT Pub. No.: WO2016/020753

PCT Pub. Date: Feb. 11, 2016

(65) Prior Publication Data

US 2017/0211271 A1 Jul. 27, 2017

(30) Foreign Application Priority Data

Aug. 4, 2014 (NO) ..... 20140961

(51) Int. Cl.
*E04B 1/21* (2006.01)
*E04B 5/02* (2006.01)
(Continued)

(52) U.S. Cl.
CPC ..... *E04B 5/04* (2013.01); *E04B 1/21* (2013.01); *E04B 1/48* (2013.01); *E04B 5/023* (2013.01); *E04B 5/02* (2013.01)

(58) Field of Classification Search
CPC ... E04B 5/04; E04B 5/02; E04B 5/023; E04B 1/21; E04B 1/215; E04B 1/24; E04B 1/48
See application file for complete search history.

(56) References Cited

U.S. PATENT DOCUMENTS 3,546,830 A 12/1970 Villaneau
3,974,612 A 8/1976 Karner
(Continued)

FOREIGN PATENT DOCUMENTS

BE 62 72 45 A 1/1963
CN 1598206 A 3/2005
(Continued)

OTHER PUBLICATIONS

International Search Report issued in PCT/IB2015/001530, dated Nov. 30, 2015 (4 pages).
(Continued)

*Primary Examiner* — Andrew J Triggs
(74) *Attorney, Agent, or Firm* — Osha Liang LLP

(57) ABSTRACT

A building element includes an upper side, a lower side, at least one first lateral face, and at least one first end face, where the at least one lateral face is formed with a longitudinal lateral groove such that a longitudinal upper grove edge and a longitudinal lower groove edge are formed. The upper groove edge has a toothed shape. A building includes one or more load bearing elements, and a plurality of building elements connected to respective load bearing elements. A method of joining building elements and load bearing elements in a building includes providing the load bearing elements with a not-cast upper part, putting up the load bearing elements, arranging two or more double T building elements therewith, pulling the telescoping elements, and cast filling the joints between the building
(Continued)

elements and the upper part of the load bearing elements such that a smooth surface is formed.

14 Claims, 5 Drawing Sheets

(51) Int. Cl.
*E04B 5/04* (2006.01)
*E04B 1/48* (2006.01)

(56) References Cited

U.S. PATENT DOCUMENTS

| | | | | | |
|---|---|---|---|---|---|
| 5,682,635 | A * | 11/1997 | Tolliver | E01D 19/125 | 14/14 |
| 6,119,427 | A * | 9/2000 | Wyman | E04B 1/12 | 52/127.11 |
| 6,625,948 | B2 * | 9/2003 | Valente | E04B 2/18 | 52/574 |
| 7,287,358 | B2 * | 10/2007 | Zambelli | E04B 1/21 | 52/223.13 |
| 8,297,026 | B1 * | 10/2012 | Bracegirdle | E04B 5/04 | 156/61 |
| 8,756,898 | B1 * | 6/2014 | Backhaus | E04B 5/023 | 404/47 |
| 8,911,173 | B2 * | 12/2014 | Ulislam | E01C 5/005 | 404/17 |
| 8,950,133 | B2 * | 2/2015 | Hansort | E04B 1/215 | 52/283 |
| 9,222,268 | B1 * | 12/2015 | Bracegirdle | E04F 15/10 | |
| 9,340,974 | B2 * | 5/2016 | Pervan | B27F 1/08 | |
| 2003/0000167 | A1 * | 1/2003 | Valente | E04B 2/18 | 52/596 |
| 2005/0220539 | A1 | 10/2005 | Yee | | |
| 2013/0042556 | A1 * | 2/2013 | Armijo | E04B 1/14 | 52/309.4 |
| 2013/0074430 | A1 | 3/2013 | Morcous et al. | | |
| 2013/0326966 | A1 | 12/2013 | Willems et al. | | |

FOREIGN PATENT DOCUMENTS

| | | | | | |
|---|---|---|---|---|---|
| CN | 201386416 | Y | | 1/2010 | |
| CN | 202672351 | U | | 1/2013 | |
| CN | 202865991 | U | | 4/2013 | |
| CN | 202925730 | U | | 5/2013 | |
| CN | 103216032 | A | | 7/2013 | |
| CN | 203049906 | U | | 7/2013 | |
| CN | 203160528 | U | | 8/2013 | |
| CN | 103526879 | A | | 1/2014 | |
| CN | 103572873 | A | | 2/2014 | |
| CN | 103572891 | A | | 2/2014 | |
| CN | 203452228 | U | | 2/2014 | |
| CN | 103572840 | B | | 7/2015 | |
| DE | 804 133 | C | | 4/1951 | |
| DE | 804133 | C | * | 4/1951 | E04B 2/56 |
| DE | 823 647 | C | | 12/1951 | |
| DE | 3150866 | A1 | | 6/1983 | |
| EP | 2 037 058 | A1 | | 3/2009 | |
| EP | 2 075 392 | A1 | | 7/2009 | |
| FR | 2 676 240 | A1 | | 11/1992 | |
| GB | 2 078 279 | A | | 1/1982 | |
| JP | H03-233058 | A | | 10/1991 | |
| JP | H09-100512 | A | | 4/1997 | |
| WO | 92/01133 | A1 | | 1/1992 | |
| WO | 2010/120179 | A2 | | 10/2010 | |

OTHER PUBLICATIONS

Written Opinion of the International Searching Authority issued in PCT/IB2015/001530, dated Nov. 30, 2015 (8 pages).
Written Opinion of the International Preliminary Examining Authority issued in PCT/IB2015/001530, dated Jul. 11, 2016 (6 pages).
International Preliminary Report on Patentability from PCT/IB2015/001530, completed on Oct. 26, 2016 (15 pages).
Norwegian Search Report issued in NO 20140961 dated Mar. 2, 2015 (2 pages).
Norwegian Search Report issued in NO 20140961 dated Jan. 27, 2016 (3 pages).

* cited by examiner

BUILDING ELEMENT, A BUILDING COMPRISING ONE OR MORE SUCH BUILDING ELEMENTS AND A METHOD FOR JOINING SUCH A BUILDING ELEMENT AND A SUPPORT ELEMENT

The present application concerns a building element, a building comprising the building element and a method of joining building elements and load bearing elements in a building.

During construction of larger buildings, such as parking houses, building elements forming the floors and load bearing elements are arranged with elements of steel which are welded together. This may be difficult and time consuming, because of the restricted space between such elements. After finishing the welding, reinforcement have to be installed across the complete surface, i.e., on top of the load bearing elements and the floor elements. Finally, a layer is cast on top the entire floor, i.e., on top of load bearing elements and the surfaces of the building elements. It is evident that this is a time consuming and cost intensive process.

Consequently, one or more embodiments of the present invention simplify the work and time for constructing a new building, and thus, reduce the costs.

This is achieved with a building element as defined in claim 1, a building according to claim 9, with at least one building element as defined in claim 1, and a method for joining building elements and load bearing elements in a building according to claim 16. Further embodiments of the invention are disclosed in the dependent claims.

Thus, there is provided a building element and a floor construction and/or roof construction in a building, which building element comprises an upper side, a lower side, at least one first lateral face and at least one first end face, wherein the at least one lateral face is formed with a longitudinal lateral groove such that a longitudinal upper groove edge is formed, and a longitudinal lower groove edge, which upper groove edge has a toothed shape.

It is emphasized that the toothed shape runs in the longitudinal direction of the upper groove edge, along the upper side of the building element, and not transversely to the at least one lateral face from the lower side to the upper side. It is also emphasized that the toothed shape of the longitudinal upper groove edge causes the upper groove edge to be equipped with a wave like form in a corresponding or similar way as the toothed shape of a cog wheel or a pitch rack.

The height of the upper groove edge in relation to the bottom of the groove is preferably stepwise varying in the longitudinal direction of the groove, whereby a toothed shape is formed.

The height of the lower groove edge in relation to the bottom of the groove is at least as high as, and preferably higher than, the maximal height of the upper groove edge in relation to the bottom of the groove. Preferably, the lower groove edge has a uniform height in the longitudinal direction of the groove in relation to the bottom of the groove.

The building elements may comprise reinforcement iron extending from the at least one end face. Preferably, possible reinforcement iron extend outward along substantially all of the at least one end face. Usually, the building element comprises a plurality of end faces with reinforcement iron extending from all end faces.

I most practical cases, the building elements will be formed with two lateral faces opposite each other, and two end faces opposite each other.

Moreover, the building element may comprise at least one rapid coupling device with a sleeve element being cast into the building element, and which opens into the at least one end face, such that a telescopic element, arranged in the sleeve element, may be pulled out from the sleeve element. This ensures the possibility of rapidly connecting the building element to an adjacent element in a building during construction of the building.

Preferably, the building element is, but not necessarily, formed as a DT element, i.e., an element having a double T shape. DT elements have two flange elements extending down from the lower side which provides the DT element with increased flexural rigidity. Of course, other types of elements may also be use, if needed.

Preferably, the building element is a parking building element, i.e., it is suitable for use in a parking building, or possibly in a storage building, or similar buildings.

Also provided is a building comprising one or more load bearing elements and a plurality of building elements as disclosed above, which are connected to the respective load bearing elements. The building elements are arranged adjacent each other such that the lateral faces are in contact with each other and the lateral grooves of the lateral faces form toothed joints. The end faces of the building elements face respective load bearing elements, and an upper part of the load bearing elements and the toothed joints are cast filled such that the load bearing elements, the joints, and the building elements form a smooth surface.

Preferably, the end faces of the building elements face respective load bearing elements, and any possible reinforcement irons, which extend from the end faces, are preferably cast into the load bearing elements. The reinforcement irons are preferably cast into an upper part of the load bearing elements.

The building may alternatively comprise threaded struts cast into the joints formed between the building elements arranged adjacent to each other, and in respective load bearing elements.

Alternatively, the end faces of the building elements preferably face respective load bearing elements, and reinforcement iron, which extend from the end faces, are cast into the load bearing elements, and the building comprises threaded struts cast into the joints formed between the building elements arranged adjacent to each other and in respective load bearing elements. Preferably, the reinforcement iron and the threaded struts are cast into an upper part of the load bearing elements.

The telescoping elements of the rapid coupling devices are preferably cast into respective load bearing elements, preferably in an upper part of the load bearing elements.

Moreover, the building is preferably arranged with a layer of a polyurethane membrane overlaid the joints and the load bearing elements such that connections are sealed. Then, penetration of liquid, such as water, is avoided.

The building, as described above, is particularly suitable as a parking building, or possibly a storage building, or the like.

Also provided is a method of joining building elements and load bearing elements in a building, the method comprising the steps of

- providing the load bearing elements without an upper part,
- put up the load bearing elements,
- arrange two or more building elements as described above, with the lateral faces facing each other such that the grooves in the lateral faces of the building elements arranged adjacent to each other form respective joints, and with the end faces of the building elements facing respective load bearing elements, cast the joints between the building elements and the upper part of the load bearing elements such that a smooth surface is formed, which surface substantially lie in the same plane as the upper side of the building elements.

Preferably, the building elements are arranged such that possible reinforcement iron extending from the end faces of the building elements extends into the upper part of the respective load bearing elements, and that the reinforcement iron are cast into the respective load bearing elements when the upper part of the load bearing elements is cast.

Alternatively, at least one threaded strut may be arranged in the joints, wherein the threaded struts also extend into the upper part of the respective load bearing elements, and that the threaded struts are cast into the joints of the respective load bearing elements when the upper part of the load bearing elements is cast.

Alternatively, both reinforcement iron and threaded struts may be used, i.e., the building elements are arranged such that reinforcement iron extending from the end faces of the building elements extend into the upper part of respective load bearing elements, and at least one threaded strut is arranged in the joints, wherein the threaded struts extend into the upper part of respective load bearing elements and that the reinforcement iron are cast into the respective load bearing elements and the threaded struts are cast into the joints and the respective load bearing elements when the upper part of the load bearing elements is cast filled.

If threaded struts are used, the length of the threaded struts may be adjusted before being cast into the joints and the load bearing elements.

Before performing the cast filling, the telescoping elements of the rapid couplings may be pulled out of the sleeve elements of the rapid coupling devices, and either into corresponding cavities in the respective load bearing elements into which they are cast, or into the upper part of the load bearing elements for then to be cast into the load bearing elements.

After the cast filling, preferably a layer of a polyurea membrane is applied to the surface, i.e., the surface which after the cast filling is constituted by the load bearing elements, building elements, and joints, which at least covers connections between building elements, and between building elements and load bearing elements.

In the following, non-limiting embodiments of the present invention will be described, with reference to the appended figures, wherein:

FIG. 1*a* shows a perspective view of two building elements arranged with the lateral faces placed adjacent each other.

FIG. 1*b* shows an enlarged view the area marked with C in FIG. 1*a*.

FIG. 2*a* shows an end view of the two building elements of FIG. 1*a*.

FIG. 2*b* shows an enlarged view of the area marked B in FIG. 2*a*.

FIG. 3 shows a perspective view of the two building elements arranged with the lateral faces placed adjacent each other, and with the end faces facing a load bearing element.

FIG. 4*a* shows the building elements and load bearing element of FIG. 3 seen from above.

FIG. 4*b* shows an enlarged view of the area marked A in FIG. 4*a*.

In the subsequent figures, the same reference numbers are used for the same technical features. Also, to avoid the figures being clotted with reference numbers, not all possible reference numbers are included in all the figures.

Figure 1A:
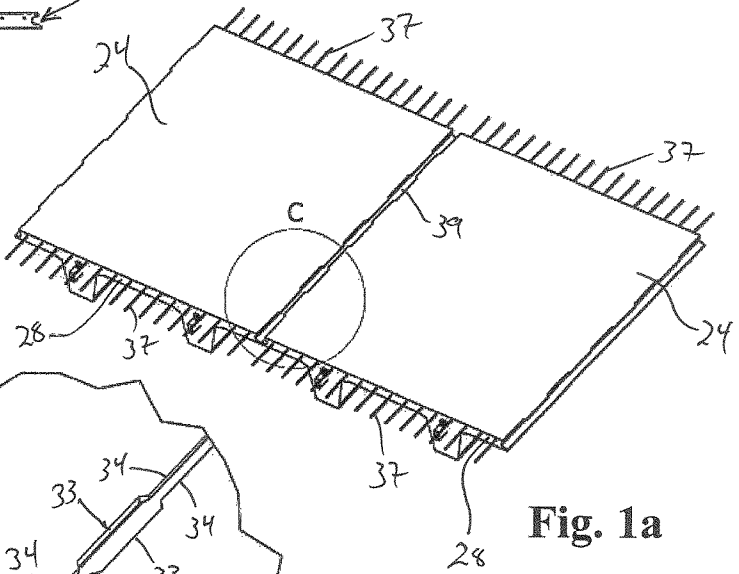
Figure 1B:
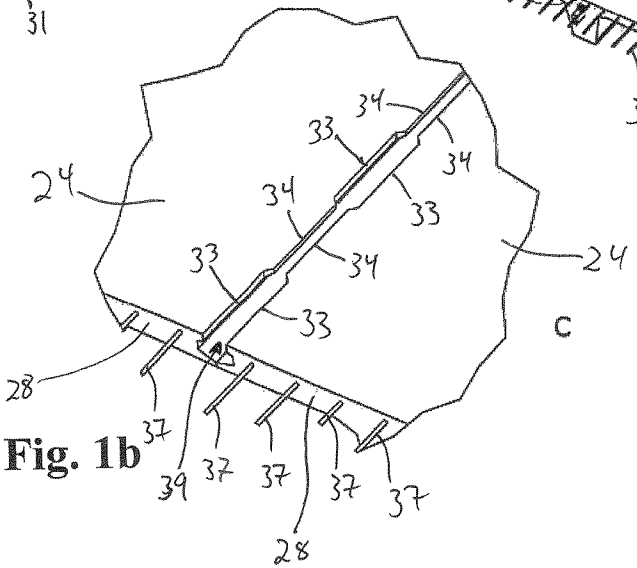
Figure 2A:
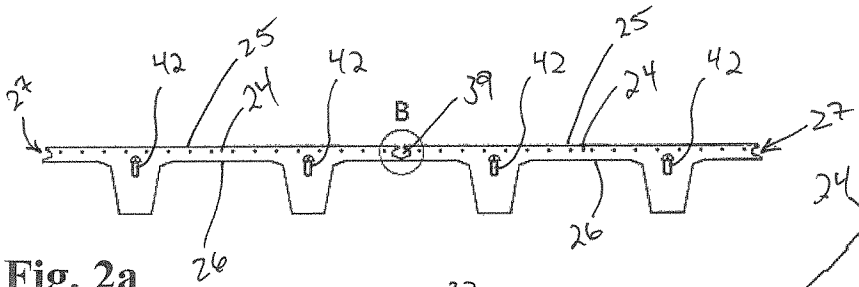
Figure 2B:
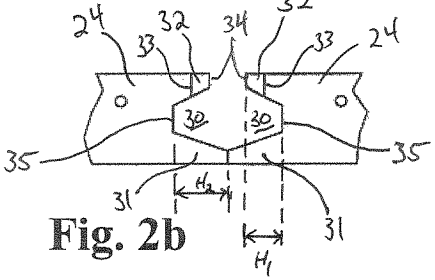

In FIGS. 1*a*, 1*b*, 2*a* and 2*b*, two building elements 24 according to the present invention are shown. Preferably, the building element 24 is of the DT type element, i.e., double T elements; however, other types of elements may be used, if desired.

The building elements 24 have an upper side 25, a lower side 26, two lateral faces 27 and two end faces 28.

As shown in the figures, the building elements 24 may be equipped with reinforcement iron 37 extending from the end faces 28; however, this is not necessary in all cases.

The lateral faces 27 of a building element 24, which is to be arranged adjacent another building element 24 when used in a building 10, are formed with a groove 30. The groove 30 is formed with a lower groove edge 31, an upper groove edge 32, and a bottom 35. Preferably, the groove edges 31, 32 extend along the whole length of the side face 27 of the building element, and together form the groove 30.

The upper groove edge 32 is toothed, as shown in the figures. The toothed shape means that displacement in the longitudinal direction (i.e., in the longitudinal direction of the groove 30) between two building elements 24 adjacent each other may be reduced, and preferably eliminated.

The toothed shape means that the upper groove edge 32 is formed with a varying height from the bottom 35 of the groove 30. The toothed shape of the upper groove edge may be differently formed. In the figures, one or more embodiments are shown wherein the height $H_1$ of the upper groove edge in relation to the bottom of the groove is stepwise varying in the longitudinal direction of the groove 30. Thus, bottoms 33 and peaks 34 are formed in the upper groove edge 32 along the upper groove edge.

The lower groove edge 31 has a uniform shape in the whole length of the groove 30. I addition, the lower groove edge 31 has a height $H_2$ from the bottom 35 of the groove which is at least as high as, and preferably higher than, the greatest height $H_1$ of the upper groove from the bottom 35 of the groove 30, i.e., the height to the top 34 of the toothed shape from the bottom 35. This means that when two building elements 24 are placed adjacent each other, the lower groove edges 31 will be arranged against each other, while a gap will exist between the two upper groove edges 32 with varying size, because of the toothed shape. Consequently, the two grooves 30 form a joint 39 which is tight in the lower side, because the lower groove edges 31 are tightly in contact, while an opening will exist on the upper side, having a varying size.

The building elements 24 may further be arranged with one or more rapid coupling devices 42. The rapid coupling devices 42 comprise a box formed sleeve element 43 cast into the building elements 24 such that the open into the end faces 28 of the building elements 24. In the sleeve elements 43 there is arranged a telescoping element 44 which may be pulled out of the sleeve elements 43 when the building elements are to be connected with respective load bearing elements 12 in a building 10.

Figure 3:
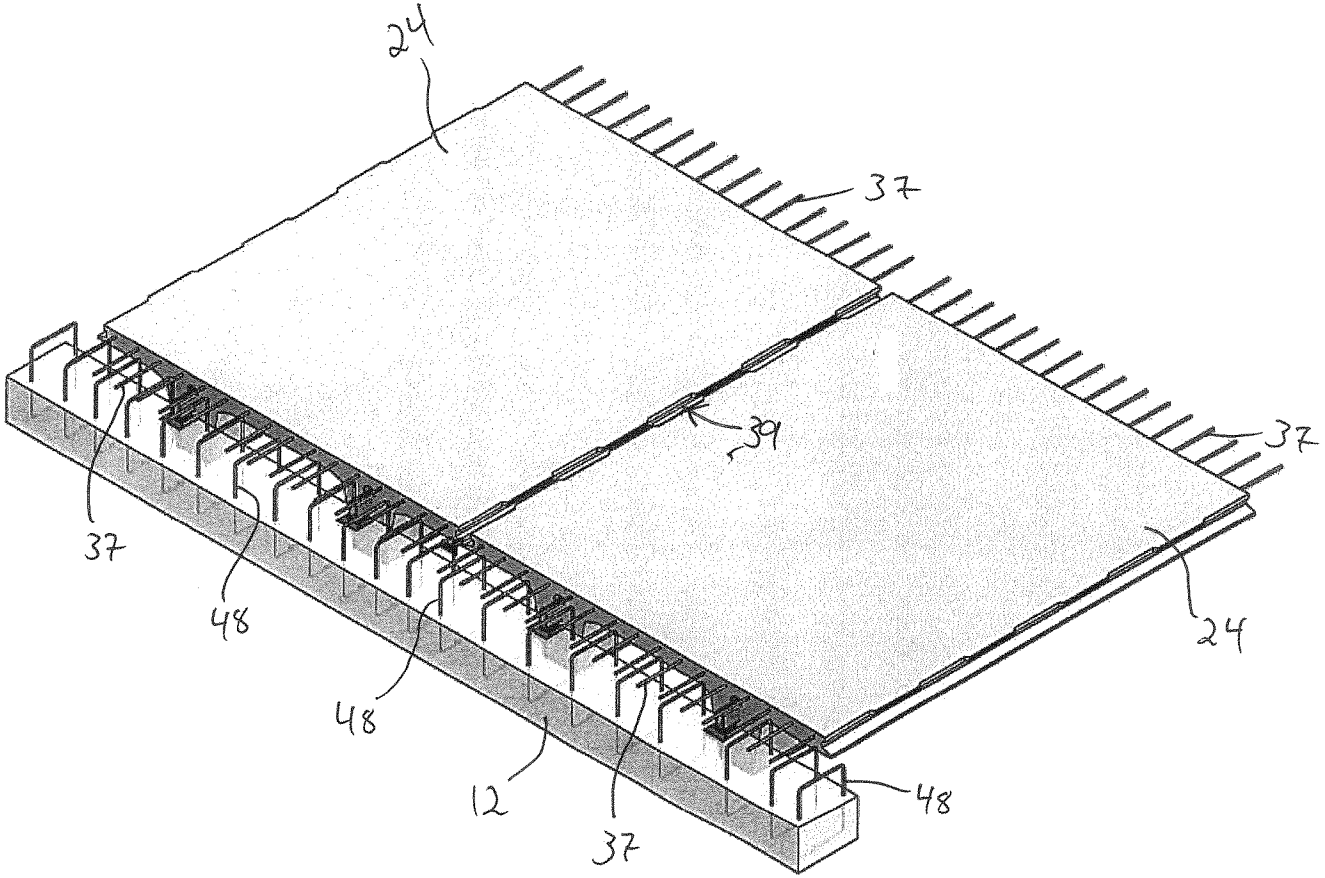
Figure 4A:
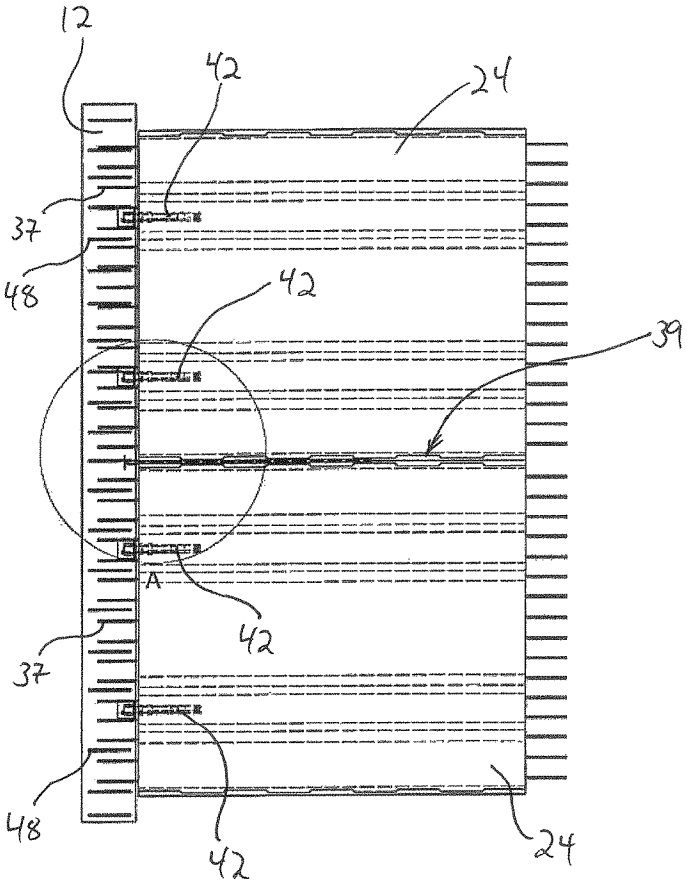
Figure 4B:
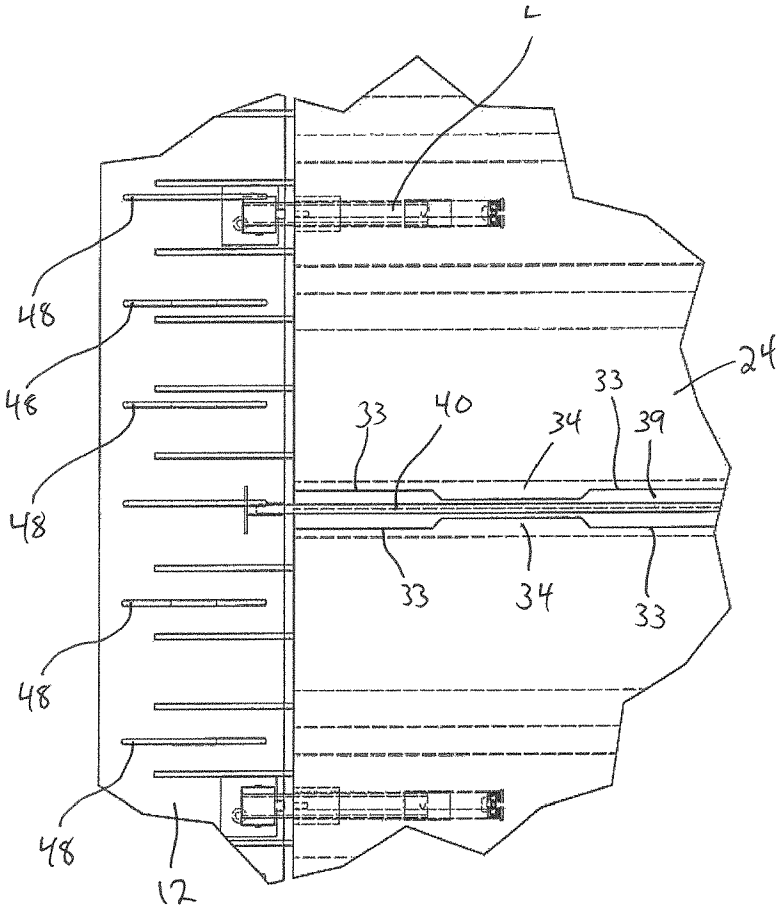
Figure 5:
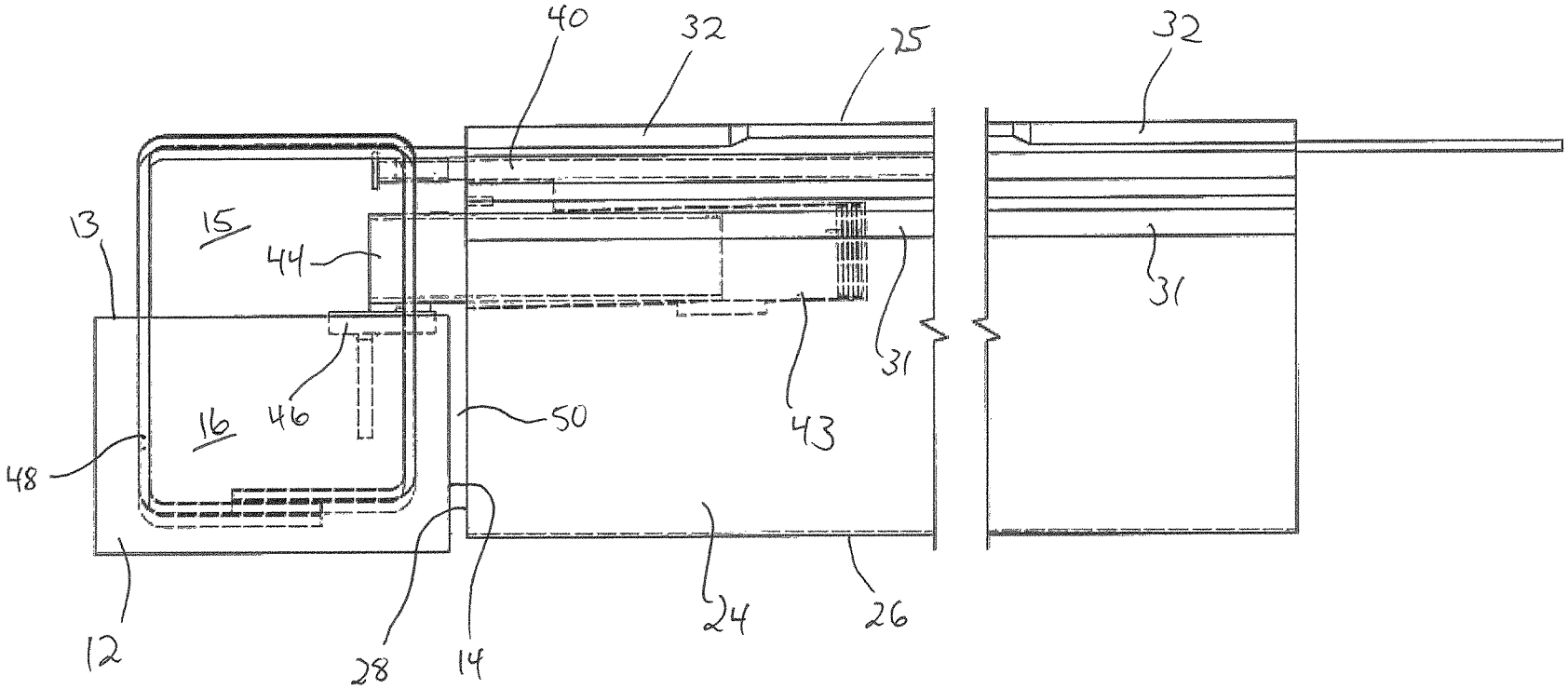
FIG. 5 shows a cross section of a building element and a load bearing element before cast filling.

In FIGS. 3-5 there is shown how building elements 24 are connected to load bearing elements 12 in a building 10.

The load bearing element 12 comprises a lower part 16 and an upper part 15. As shown in the figures, the upper part 15 is not cast filled when produced, but is cast filled when it is to be connected to building elements 24, as further explained below.

The load bearing element comprises reinforcement iron, e.g., in the form of a number of loop shaped reinforcement irons 48 which are cast into the lower part and extend into the upper part.

Preferably, the lower part 16 is also arranged with a number of load bearing parts 46 which correspond to the number of rapid coupling devices 42 in the building elements 24. The load bearing parts 46 are preferably cast into the lower part 16. When the building elements 24 are arranged with the end faces 28 facing respective load bearing elements 12 the telescoping elements 44 may be pulled out of their respective sleeve elements 43 such that they are resting on respective load bearing parts 46.

As mentioned above, the building elements 24 may be arranged with reinforcement iron 37 extending from the end faces 28. These reinforcement irons will extend into the upper part of the respective load bearing elements 12, and thus, be casted into the upper part 15 when the upper part and the joints are cast filled.

However, it is not necessary to arrange the building elements with the reinforcement irons 37. In stead, threaded struts 40, which may be longitudinally adjustable, may be arranged such that they extend a desired distance into the joints 39, and into the upper part 15 of the respective load bearing elements 12. Thus, the threaded struts 40 will be cast into upper part 15 when the upper part and the joints 39 are cast filled.

It would also be possible to use building elements 24 with reinforcement iron 37 extending from the end faces 28 and threaded struts 40 arranged in the joints 39, as shown in the figures. Both the reinforcement irons 37 and the threaded struts 40 will extend into the upper part 15 of the respective load bearing elements 12, and will be cast into the upper part 15 when the upper part and the joints are cast filled.

Dependent on how strong connection between building elements 24 and the respective load bearing elements is necessary, it is thus possible to use exclusively reinforcement iron 37 which are cast into the building elements 24 extending out from the end faces 28, exclusively threaded struts 40 which are arranged in and cast into the joints 39 between two building elements 24, or one may use both reinforcement iron 37 and threaded struts 40.

Figure 6:
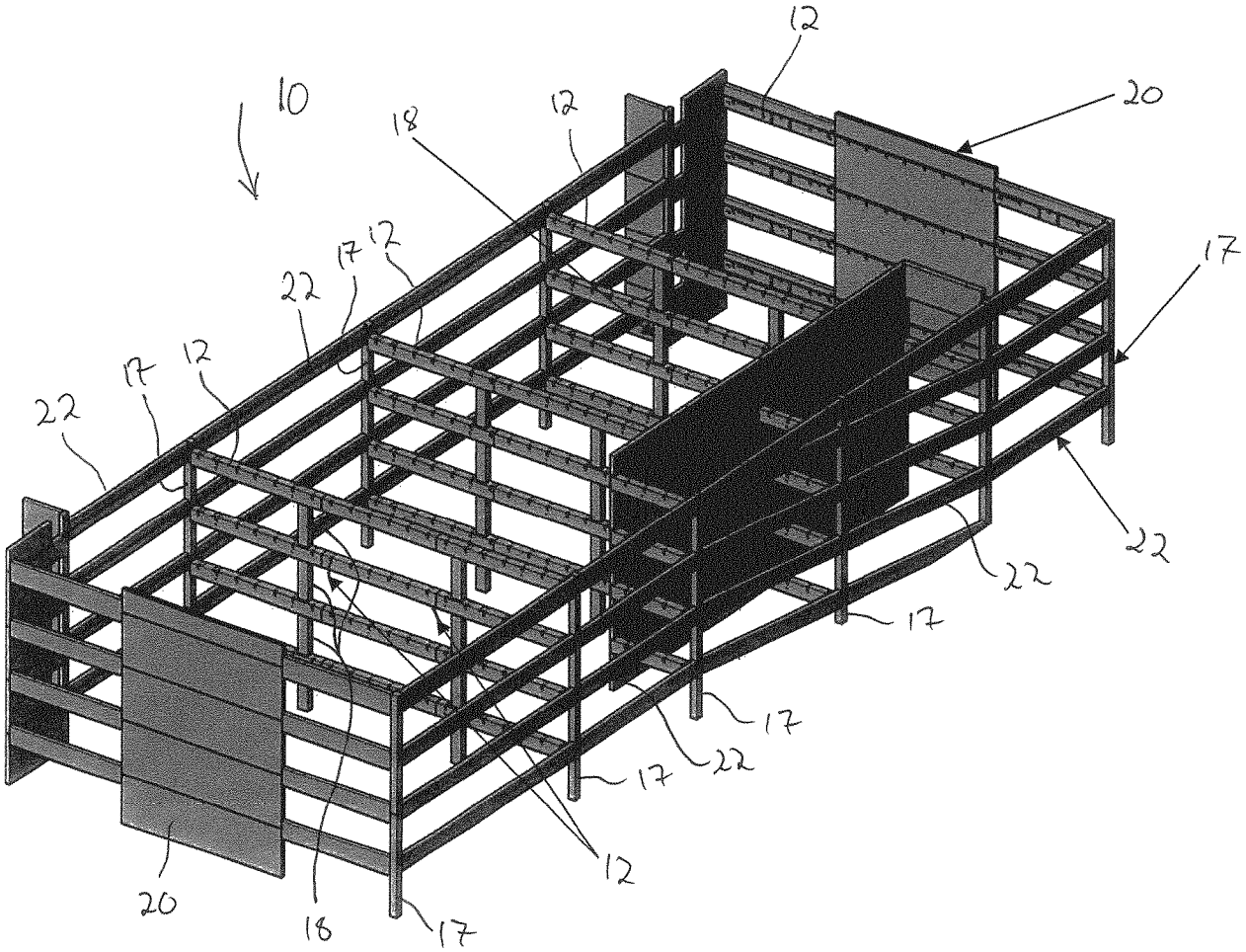
FIG. 6 shows the framework in a building before the building elements are joined to the load bearing elements.

In FIG. 6, a building 10 is shown, e.g., a parking building, without the building elements 24. The building 10 comprises several elements which contribute to the load bearing construction. Of course, this may be performed in many different ways, and will vary from building to building. However, the shown building illustrates an example, and the skilled artisan would easily be able to find variations of this example.

Preferably, the building comprises a number erected load bearing columns 17, and a number of load bearing walls 20. In a longitudinal direction, the load bearing columns 17 are connected, and the load bearing walls 20 are connected to beams 22. The outermost building elements will have a lateral face 27 abutting a beam 22. This lateral face is then preferably formed with a groove 30.

In the transverse direction, load bearing columns 17 and load bearing walls are connected with load bearing beams 12 as described above. When the load bearing elements are erected, they will appear as shown in FIGS. 3-5, i.e., the upper part 15 of the load bearing elements are not cast filled. The end faces 28 of the building elements 24 will face such a load bearing beam and are connected with this beam as described above.

When the building elements 24 are connected to the bearing elements, they are arranged such that the end faces 28 face a load bearing element 12. Possible reinforcement iron extending from the end faces 28 will extend into the not cast filled upper part 15 of the load bearing elements. Possible threaded struts, or similar elements which may function as reinforcing elements, are arranged in the joints formed by the grooves in the lateral faces of two building elements 24 adjacent each other, and the length is adjusted such that the threaded struts extend in a desired distance into the not cast filled upper part 15 of the load bearing elements. Further, the telescoping elements 44 are pulled out from the sleeves 43 of the rapid coupling devices such that they are resting on respective load bearing parts 46. The upper part 15 of the load bearing elements, the joints 39, and the openings 50 between the load bearing elements 12 and the building elements 24 are then cast filled such that a smooth surface substantially is flush with the upper sides 13 of the building elements is formed. Below the openings 50 between the lateral faces 14 of the load bearing elements and the end faces 28 of the building elements there may be arranged a temporary casting frame which stops cast from running out of the opening during the cast filling. After the cast filling, there may be arranged a layer of a polyurethane membrane (not shown in the figures) on top the joints and the connections between the load bearing elements 12 and the building elements 24, such that the connections are sealed for penetration of liquid such as water.

Thus, with the present invention, one avoids welding and reinforcement iron which have to be placed on top of load bearing elements and floor elements, and all that needs to be done is to cast fill the upper part of the load bearing elements 12, the joints between the building elements 24 (the floor elements) and possibly the openings/cracks 50 between load bearing elements 12 and building elements 24. Summarized, this provides for substantial saving of time and costs compared to known solutions for constructing buildings such as parking buildings, storage buildings, halls and other buildings in which the present invention may be used.

The invention claimed is:

1. A double T shaped building element for at least one member of a group consisting of a floor construction and a roof construction in a building, the building element comprising:

an upper side, a lower side, at least one first lateral face, at least one first end face, and two flange elements extending down from the lower side, wherein the building element comprises reinforcement iron that extend out from the at least one end face for casting into a load bearing element, wherein the at least one lateral face is formed with a longitudinal groove such that a longitudinal upper groove edge and a longitudinal lower groove edge are formed where the upper groove edge and the lower groove edge extend along a whole length of the lateral face, wherein the upper groove edge has a toothed shape, and wherein the building element comprises at least one rapid coupling device, the at least one rapid coupling device comprising a sleeve element that is cast embedded into the building element and terminating in the same at least one first end face as the reinforcement irons such that a telescoping element, arranged in the sleeve element, is configured to be pulled out of the sleeve element and to be cast into the load bearing element together with the reinforcement iron.

2. The building element according to claim 1, wherein a height of the upper groove edge in relation to a bottom of the groove is stepwise variable, whereby the toothed shape is formed.

3. The building element according to claim 1, wherein a height of the lower groove edge in relation to a bottom of the groove is at least as high as, and preferably higher than, a largest height of the upper groove edge in relation to the bottom of the groove.

4. The building element according to claim 1, wherein the reinforcement iron extend out along substantially all of the at least one end face.

5. The building element according to claim 1, wherein the building element comprises a plurality of end faces, and that the building element comprises reinforcement iron extending out from all the end faces.

6. A building comprising:

one or more load bearing elements and a plurality of double T building elements, the plurality of double T building elements being connected to respective load bearing elements, the building elements being arranged adjacent each other such that the at least one lateral face lie next to each other, and lateral grooves in the lateral faces form toothed joints, wherein the building elements are double T building elements according to claim 1 and wherein the end faces of the building elements face respective load bearing elements such that the reinforcement irons and the telescopic elements of the rapid coupling elements of the double T building elements extend into an upper part of the load bearing elements, and wherein the upper part of the load bearing elements and the toothed joints are cemented in such that the telescopic elements and the reinforcement irons are cast into the load bearing elements and such that the load bearing elements, the joints and the upper sides of the building elements form a smooth surface that is substantially co-planar with the upper sides of the building elements, the upper sides of the building elements being substantially planar.

7. The building according to claim 6, wherein the building comprises threaded struts, the threaded struts being cast into the joints formed between the building elements arranged adjacent to each other, and in respective load bearing elements.

8. The building according to claim 6, wherein the telescoping element of the rapid coupling device are cast into the respective load bearing elements.

9. The building according to claim 6, wherein the building is arranged with a layer of polyurethane membrane overlaid the joints, and the load bearing elements such that connections are sealed.

10. The building according to claim 6, wherein the building is a parking building or a storage building.

11. A method of joining building elements and load bearing elements in a building, the method comprising:

providing the load bearing elements with an upper part that is not cast, putting up the load bearing elements, arranging two or more double T building elements according to claim 1 with the lateral faces facing each other such that the grooves in the lateral faces of the building elements arranged adjacent to each other form respective joints, and with the end faces of the building elements facing respective load bearing elements such that the reinforcement irons that extend out from the at least one end face of the double T building elements, extend into the upper part of the load bearing elements, pulling the telescoping elements out of the rapid coupling devices either into corresponding cavities in the respective load bearing elements, the rapid coupling devices being cast founded into the respective load bearing elements, or into the upper part of the load bearing elements for then to be casted into the load bearing elements, cast filling the joints between the building elements and the upper part of the load bearing elements such that the telescopic element and the reinforcement irons are cast into the load bearing elements and such that a smooth surface is formed, the smooth surface being substantially co-planar with the upper sides of the building elements, the upper sides of the building elements being substantially planar.

12. The method according to claim 11, wherein at least one threaded strut is arranged in the joints wherein the threaded struts extend into the upper part of respective load bearing elements, and wherein the threaded struts are cast into the joints and the respective load bearing elements.

13. The method according to claim 12, wherein a length of the threaded struts is adjusted before being cast into the joints and the load bearing elements.

14. The method according to claim 11, wherein, after the casting, a layer of a poly urea membrane is arranged on the smooth surface, and wherein the layer at least covers connections between building elements and between building elements and load bearing elements.

* * * * *